US008347414B2

(12) United States Patent
Terpinski

(10) Patent No.: US 8,347,414 B2
(45) Date of Patent: Jan. 8, 2013

(54) MAGNETIC FINGER GLOVE

(75) Inventor: Casper M. Terpinski, San Antonio, TX (US)

(73) Assignee: TurnPro, LLC, Houston, TX (US)

( * ) Notice: Subject to any disclaimer, the term of this patent is extended or adjusted under 35 U.S.C. 154(b) by 1683 days.

(21) Appl. No.: 11/346,474

(22) Filed: Feb. 2, 2006

(65) Prior Publication Data

US 2006/0185057 A1 Aug. 24, 2006

Related U.S. Application Data

(60) Provisional application No. 60/651,436, filed on Feb. 10, 2005.

(51) Int. Cl.
*A41D 19/00* (2006.01)

(52) U.S. Cl. ..... 2/161.6; 2/159; 2/160; 2/163; 2/21

(58) Field of Classification Search ..... 2/160, 161.6, 2/163, 167, 16, 20, 21; 294/25; 223/101; D3/29; D2/616
See application file for complete search history.

(56) References Cited

U.S. PATENT DOCUMENTS

| | | | | |
|---|---|---|---|---|
| 1,174,887 A | | 3/1916 | Meriwether | |
| 1,301,093 A | * | 4/1919 | Bradford | 223/101 |
| 2,600,647 A | * | 6/1952 | Hauser | 294/25 |
| 3,636,568 A | | 1/1972 | Stuner | |
| 4,325,504 A | | 4/1982 | Amani | |
| 4,926,718 A | * | 5/1990 | Cook | 81/44 |
| 4,944,437 A | * | 7/1990 | Calvert | 223/101 |
| 4,955,515 A | * | 9/1990 | Brull | 223/101 |
| 5,449,103 A | * | 9/1995 | Tilley | 224/244 |
| 5,593,073 A | | 1/1997 | Finnegan | |
| 5,720,046 A | * | 2/1998 | Lopez et al. | 2/159 |
| 5,795,248 A | | 8/1998 | Giglio | |
| 6,038,697 A | * | 3/2000 | Kasarnich | 294/25 |
| 6,052,828 A | * | 4/2000 | Widdemer | 2/161.2 |
| 6,275,996 B1 | * | 8/2001 | Redwood et al. | 2/160 |
| 6,618,860 B1 | * | 9/2003 | Sullivan et al. | 2/159 |
| 6,779,199 B1 | | 8/2004 | O'Dea et al. | |

OTHER PUBLICATIONS

Jun. 30, 2004 letter from Mr. Terpinski to Griot's Garage seeking to establish a business relationship with Griot's Garage.
Purchase agreement, signed Nov. 19, 2004, between Griot's Garage and Turnpro LLC.

* cited by examiner

*Primary Examiner* — Khoa Huynh
*Assistant Examiner* — Sally Haden
(74) *Attorney, Agent, or Firm* — Eric W. Cernyar, PC

(57) ABSTRACT

A magnetic finger glove helps persons hold, install, and retrieve small metallic objects, such as nuts or screws, in hard-to-reach places. The finger glove is sized and shaped to sheathe and conform to an adult human index finger. A small round disc neodymium magnet is affixed to a fabric assembly in the region corresponding to the fingertip. The magnet weighs less than 0.002 pounds and is small enough to be confined within an area on the fabric assembly of less than 0.5 square inches. Yet, the magnet has a holding force of at least 1 pound.

20 Claims, 3 Drawing Sheets

MAGNETIC FINGER GLOVE

RELATED APPLICATIONS

This application claims priority to U.S. Provisional Patent Application No. 60/651,436, filed Feb. 10, 2005, and entitled "Magnetic Finger Glove," which is herein incorporated by reference.

FIELD OF THE INVENTION

This invention relates to gloves, and more particularly, to gloves designed to facilitate the gripping or holding of objects.

BACKGROUND OF THE INVENTION

While working in a tight space such as under the hood of a car, people routinely encounter difficulties in positioning nuts, screws, and bolts in hard-to-reach places for fastening. Often times, a nut must be started at an angle and/or in a position obstructed from view. Unable to position the nut by sight, the person must position it by feel. During this process, it is common to drop or lose the nut. Countless mechanics working on cars and other assemblies have experienced the frustration of dropping and losing the fastener in some crook, cranny, or crevice.

In many hard-to-reach places, a magnetized screwdriver or other common tool is generally unsuitable for positioning a nut. A magnetized screwdriver may also be unsuitable for positioning and starting a screw when the target position is obstructed from view or when the screw is most easily started by hand. Furthermore, a telescoping magnetic pick-up tool is not always suitable for picking up dropped metallic objects.

SUMMARY OF THE INVENTION

Therefore, there is a need for a tool that prevents or minimizes droppage of nuts, screws, and other small metallic fasteners and objects, without getting in the way of direct finger manipulation of the fastener. There is also a need for alternative ways to retrieve dropped metallic objects.

The present invention meets this need with a magnetic finger glove. The finger glove is made from an assembly of fabric pieces with size, shape, and material characteristics designed to stay on and comfortably conform to an adult human index finger. The magnetic finger glove comprises, preferably, a single small round disc neodymium magnet, rated with a maximum energy product of between 35 and 54 megagauss-oersteds, affixed to a fabric assembly in the region corresponding to the distal segment (i.e., fingertip) of the index finger. The magnet weighs less than 0.002 pounds and is small enough to be confined within an area on the fabric assembly of less than 0.5 square inches. Yet, the magnet has a holding force of at least 1 pound. A person wearing the finger glove can magnetically grasp small metal objects with his fingertip. Other embodiments may include multiple magnets of different powers, sizes, and types.

The finger glove fabric assembly comprises an upper panel with an elastic region corresponding to at least the proximal and middle segments of the dorsal (i.e., back) side of the finger and a substantially non-elastic bottom panel with an surface area corresponding to the palmar side of the finger. In one embodiment, the magnet is affixed to the bottom panel in a region corresponding to the distal segment of the finger. In another embodiment, the magnet is affixed to the bottom panel in a sub-region proximate to the ventral side of the distal phalanx head of the finger, whereby the finger glove facilitates tactile sensation by the person wearing the glove of the attachment of a small metallic object to the finger glove. In a third embodiment, the magnet is affixed to the top upper panel in the region corresponding to the fingernail of the finger.

The present invention also provides a full-hand glove embodiment sized to conform to a human hand, with a small magnet affixed to the forefinger in the region corresponding to the distal segment of the index finger. Preferably, the magnet is affixed to the part of the forefinger corresponding to the top of the fingernail.

A more detailed appreciation of the invention is provided in the following detailed description and the annexed sheets of drawings, which illustrate the invention.

DETAILED DESCRIPTION

Figure 1:
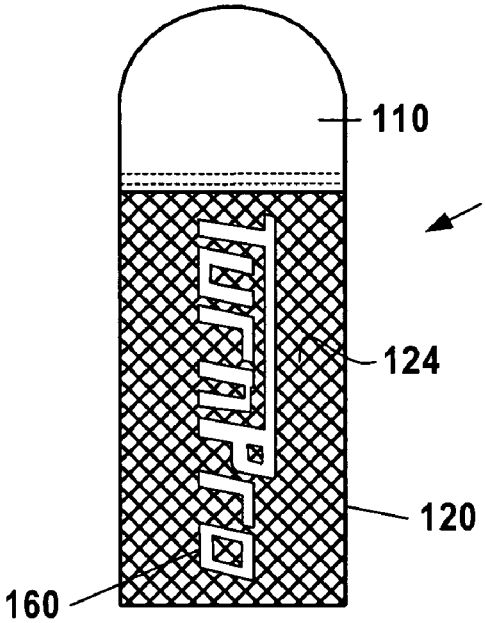
FIG. 1 is an outside view of the dorsal (top) side of one embodiment of a finger glove.
Figure 2:
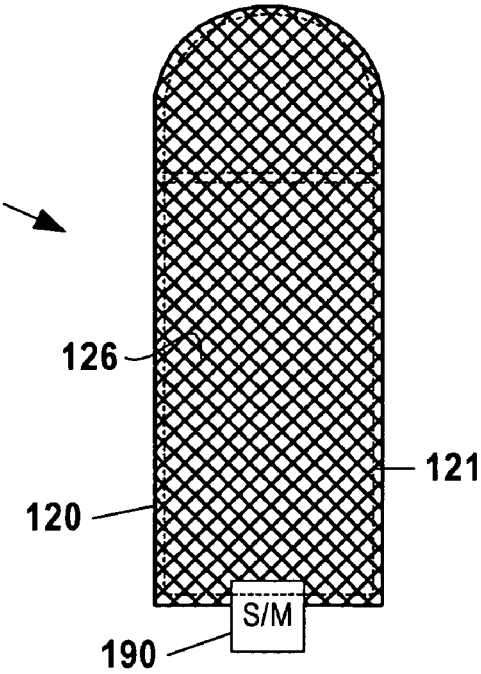
FIG. 2 is an inside view of the dorsal (top) side of the finger glove of FIG. 1.
Figure 3:
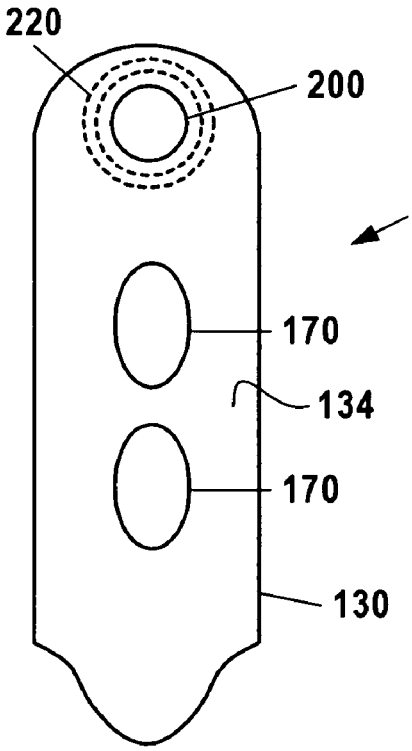
FIG. 3 is an outside view of the palmar (bottom) side of the finger glove of FIG. 1.
Figure 4:
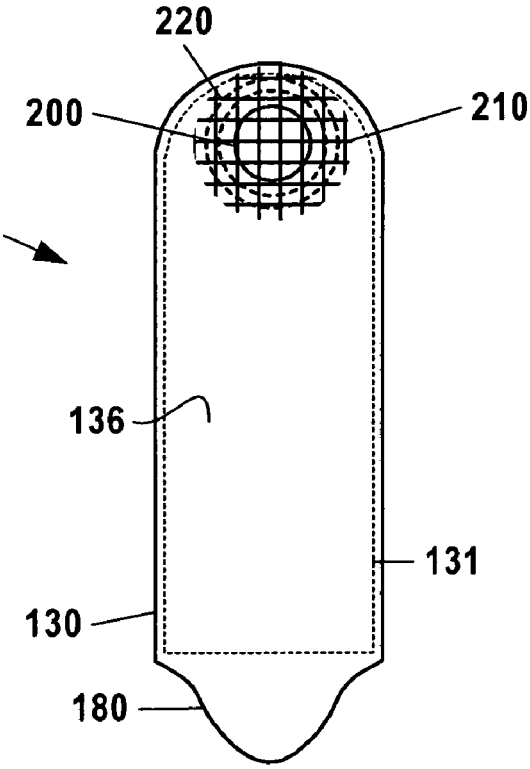
FIG. 4 is an inside view of the palmar (bottom) side of the finger glove of FIG. 1.

Before the subject invention is described further, it is to be understood that the invention is not limited to the particular embodiments of the invention described below or depicted in the drawings. Many modifications may be made to adapt or modify a depicted embodiment without departing from the objective, spirit and scope of the present invention Therefore, it should be understood that, unless otherwise specified, this invention is not to be limited to the specific details shown and described herein, and all such modifications are intended to be within the scope of the claims made herein.

Figure 10:
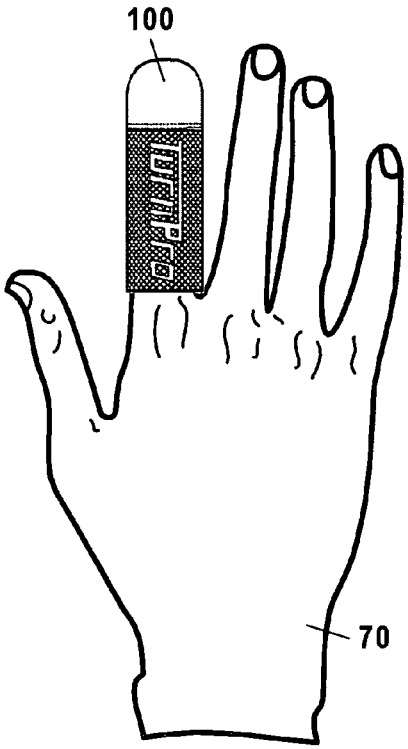
FIG. 10 is a top or dorsal view of a human hand wearing the finger glove of FIG. 1.
Figure 11:
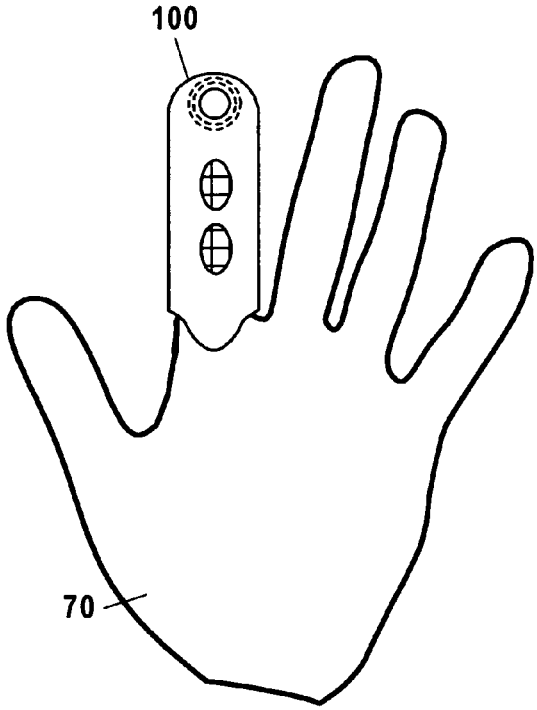
FIG. 11 is a palmar view of a human hand wearing the finger glove of FIG. 1.

FIGS. 1-5 show various views of one embodiment of a finger glove (or cot or fingerstall) 100 according to the present invention. Use of the terms "dorsal" and "palmar" are used herein to refer to those portions of the glove 100 in contact with the dorsal (back-of-the-hand) and palmar surfaces, respectively, of a human hand 70 wearing the finger glove 100, as shown in FIGS. 10 and 11.

The finger glove 100 is formed of a cooperative assembly of fabric pieces, including a top side fabric piece 120 sized and dimensioned to fit at least over the dorsal region of the proximal and middle segments of the finger, a bottom side fabric piece 130 sized and dimensioned to fit over the palmar region of the finger, and a bridging fabric piece 140 that joins the top side fabric piece 120 to the bottom side fabric piece 130. The finger glove 100 is preferably manufactured to two sizes—a small/medium size approximately 3 inches long by 1.125 inches wide and a large/extra large size approximately 3.25 inches long by 1.25 inches wide.

Both the top side fabric piece 120 and the bridging fabric piece 140 are formed of one or more elastic materials to help secure the finger glove 100 to the finger. The material should be both comfortable and of sufficient elasticity so that the top side fabric piece conforms to the ventral region of the finger in both the straightened and articulated positions. Most preferably, the top side fabric piece 120 is made of a four-way stretch synthetic fabric such as spandex, which is marketed by Invista Corp. of Wichita, Kans. under the trademark LYCRA®. A two-way stretch fabric is sufficient for the bridging fabric piece 140. A fingertip cap 110 made of a comfortable, protective, leathery-feeling and substantially non-elastic fabric (such as the synthetic leather fabric frequently marketed under the trademark AMARA® which is a registered trademark of Kuraray Co. of Japan), may be affixed to the distal portion of the top side fabric piece 120 corresponding to the fingernail of the wearer. The bottom side fabric piece 130 is also made of a comfortable, protective, leathery-feeling and substantially non-elastic fabric such as AMARA® brand synthetic leather. Although not shown in the drawings, additional lining may be placed on the inside to provide additional comfort to the wearer.

A disc magnet 200 is placed on the inside surface 136 of the distal portion of bottom-side fabric piece 130, corresponding to the distal segment of the index finger. A disc pouch fabric piece 210 large enough to cover the magnet 200 is placed over the magnet 200 and affixed to the inside surface 136 of the bottom-side fabric piece 130 using glue, a weld, or one, two or more circles of stitches 220. The closer the magnet 200 is to the very tip of the finger, the easier it will be for the thumb and middle finger to manipulate a metallic object (e.g., turn a nut) magnetically suspended from the index fingertip. For this reason, the magnet is placed as close to the tip of the bottom-side fabric piece 130 (preferably less than 1 cm from the tip) as practicable.

In order to inform the wearer of the location of the magnet, the stitches 220 are preferably made of a thread whose color contrasts highly with the color of the bottom side fabric piece 130. For example, forming the stitches using a red thread creates the appearance of a bulls-eye target location on the finger glove 100. Alternatively, a circle, dot, or bulls-eye decoration can be dyed or imprinted on the outside surface 134 of the bottom side fabric piece 130 pinpointing the location of the magnet 200.

Figure 5:
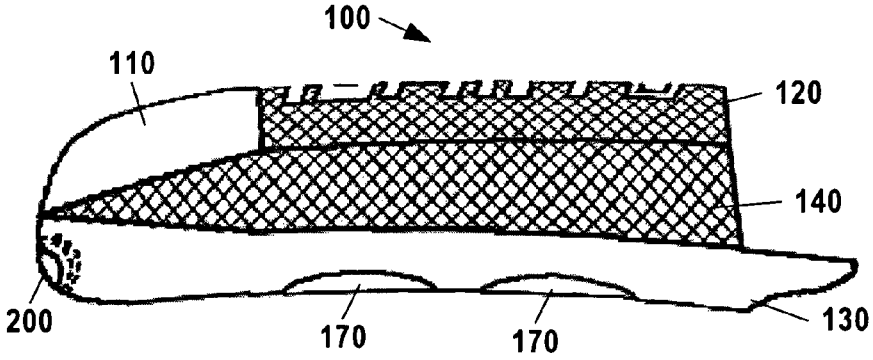
FIG. 5 is a side view of the finger glove of FIG. 1.
Figure 6:
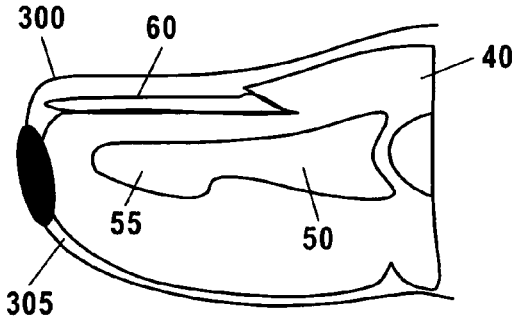
FIG. 6 depicts an embodiment of a finger glove with a disc magnet located proximate the ventral side of the distal phalanx head of a human index finger wearing the glove.
Figure 7:
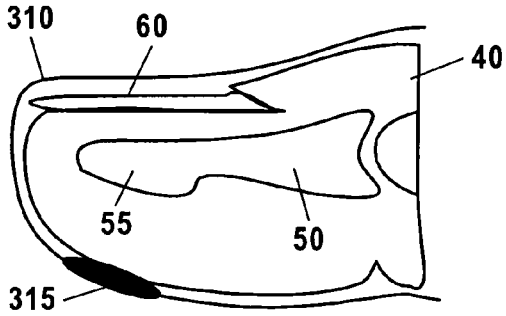
FIG. 7 depicts another embodiment of a finger glove with a disc magnet located proximate to the midpoint of the palmar side of the fingertip of a human index finger wearing the glove.
Figure 8:
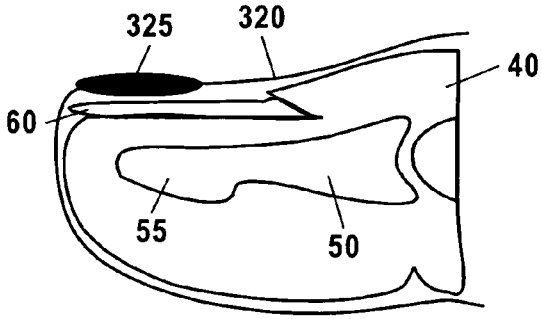
FIG. 8 depicts yet another embodiment of a finger glove with a disc magnet located proximate to the nail plate of a human index finger wearing the glove.

The top side fabric piece 120 is joined at its periphery to the bridging fabric piece 140 with stitches 121. The bottom side fabric piece 130 is also joined at its periphery to the bridging piece 140 with stitches 131. As shown in FIG. 5, the bridging piece 140 is wider near the opening of the finger glove 100 than at the finger tip, giving the finger glove 100 a pinch style tip.

FIGS. 1-5 also depicts other features of the finger glove 100. Silicone ovals 170 may be affixed to the outside surface 134 of the bottom side fabric piece 130 to facilitate gripping, and also to enhance the visual appearance of the finger glove 100. The bottom side fabric piece 130 may include an integral pull tab 180 to assist the user with putting it on. The integral pull tab 180 also facilitates attachment of the finger glove 100 to a header card for displaying the finger glove on a merchandise hook. A tag 190 affixed to the proximal portion of the inside surface 126 of the top side fabric piece 120 identifies the size and place of manufacture, or manufacturing company, of the finger glove 100. Finally, a logo 160 for trademark identification can be conveniently welded or silk-screened onto the outside surface 124 of the top side fabric piece 120.

The magnet 200 is preferably small enough to minimize interference with normal handling, powerful enough to hold small lightweight metal objects like nuts, but not so powerful that it accelerate metallic objects to the user's finger so quickly that it hurts, stuns, or irritates the user's finger. Consequently, it is preferred that the magnet 200 have a holding force of between about eight ounces and two pounds, more preferably, about one pound.

In one embodiment, a round disc magnet is used having an approximately 0.375-inch (0.95-cm) diameter and an approximately 0.06-inch (0.15-cm) thickness. This equates to a volume of about 0.0066 cubic inches or 0.11 cubic centimeters. Smaller or larger sizes may be utilized in the alternative depending on the application and the size of the objects one needs the magnet to carry.

The online encyclopedia WIKIPEDIA reports that neodymium magnets are made of a combination of mostly neodymium, iron, and boron, according to the chemical formula $Nd_2Fe_{14}B$. This website also reports that neodymium magnets have about 18 times as much strength, per unit volume, as ceramic magnetic material, and can lift several hundred times their own mass. Other websites report that neodymium magnets have about 10 times the strength of a comparable ceramic magnet. Neodymium magnets are graded in strength from N24 to N54, with the number following the N representing the magnetic energy product (more commonly referred to as "maximum energy product"), in megagauss-oersteds (MGOe) (1 MG·Oe=7,957 T·A/m=7,957 J/$m^3$). Thus, a N35 neodymium magnet would have a maximum energy product of 35 MGOe, and a N40 neodymium magnet would have a maximum energy product of 40 MGOe. More information concerning rare earth magnets can be found in U.S. Pat. Nos. 4,802,931 to Croat and 4,496,395 to Croat, which are herein incorporated by reference.

The website www.wikipedia.org reports that neodymium magnets are made of a combination of mostly neodymium, iron, and boron, according to the chemical formula $Nd_2Fe_{14}B$. This website also reports that neodymium magnets have about 18 times as much strength, per unit volume, as ceramic magnetic material, and can lift several hundred times their own mass. Other websites report that neodymium magnets have about 10 times the strength of a comparable ceramic magnet. Neodymium magnets are graded in strength from N24 to N54, with the number following the N representing the magnetic energy product (more commonly referred to as "maximum energy product"), in megagauss-oersteds (MGOe) (1 MG·Oe=7,957 T·A/m=7,957 J/$m^3$). Thus, a N35 neodymium magnet would have a maximum energy product of 35 MGOe, and a N40 neodymium magnet would have a maximum energy product of 40 MGOe. More information concerning rare earth magnets can be found in U.S. Pat. Nos. 4,802,931 to Croat and 4,496,395 to Croat, which are herein incorporated by reference.

Neodymium-iron-boron magnets have a density of approximately 0.27 pounds per cubic inch or 7.5 g per cubic centimeter. Thus, a small 0.0066 cubic inch or 0.11 cubic centimeter magnet would have a weight of about 0.0018 pounds or 0.825 grams. Such a small magnet should hold more than 600 times its mass, or at least one pound.

FIGS. 6-9 depict four different finger glove embodiments, each one mounting one or more magnets in different places in the region of the finger glove corresponding to the fingertip 40. In one embodiment of the finger glove 300 (FIG. 6), the magnet 305 is placed on the very end of the fingertip of the glove 300. In another embodiment of the finger glove 310 (FIG. 7), the magnet 315 is placed about a tenth of an inch back from the very tip. When a finger is inserted into the glove 310, the magnet 305 will be proximate to the ventral side of the distal phalanx head 55 of the finger 40, a region of acute tactile sensation.

Figure 9:
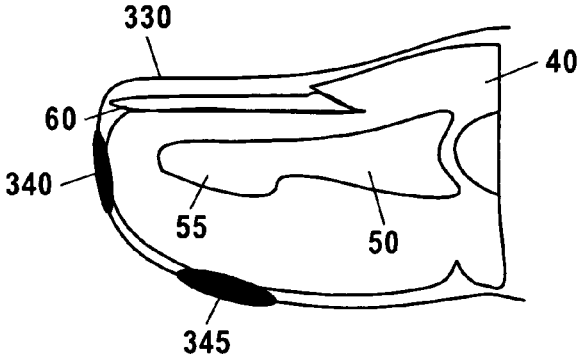
FIG. 9 depicts a further embodiment of a finger glove with a first disc magnet located proximate to the ventral side of the distal phalanx head and a second disc magnet proximate to the nail plate of a human index finger wearing the glove.

In yet another embodiment of the finger glove 320 (FIG. 8), the magnet 325 is affixed to the top side fabric piece 120 or fingertip cap 110 (FIG. 1). When a finger 40 is inserted into glove 320, the magnet 325 will be proximate to the tip of the nail plate 60 of the finger 40. With this embodiment, a person can hold a small metallic fastener (such as a screw or nut) on the back of the dorsal side of the finger glove 320 while using the fingertip to feel around for the opening or shaft in which to insert or attach the fastener. Once located, the person can use his thumb and middle finger to retrieve the fastener and place it in its proper location. FIG. 9 depicts a finger glove 330 embodiment comprising two disc magnets 340 and 345 placed on the dorsal side of the finger glove, one at the very tip of the finger, and the other backed off about ¼ inch. Other embodiments, not shown, may include one disc magnet placed on the dorsal side of the finger glove, in the region of the fingernail, and another on the ventral or palmar side of the finger glove.

Figure 12:
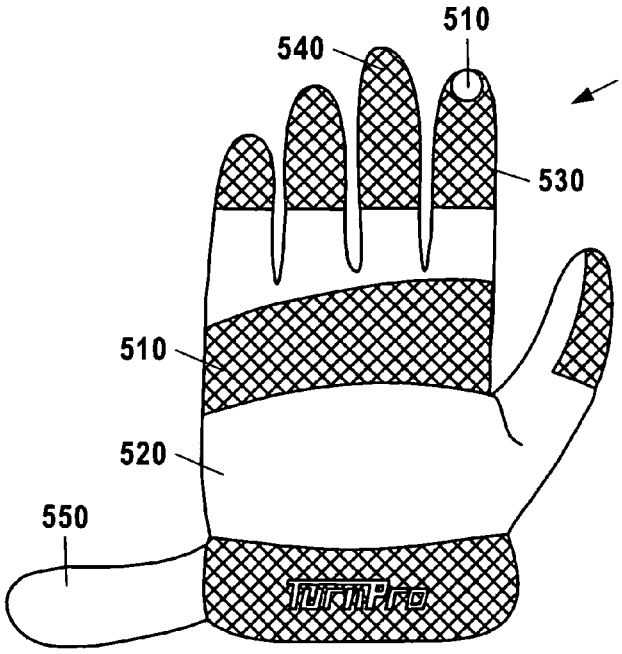
FIG. 12 is a dorsal view of one embodiment of a full-hand glove with a disc magnet sewn into the forefinger of the glove.
Figure 13:
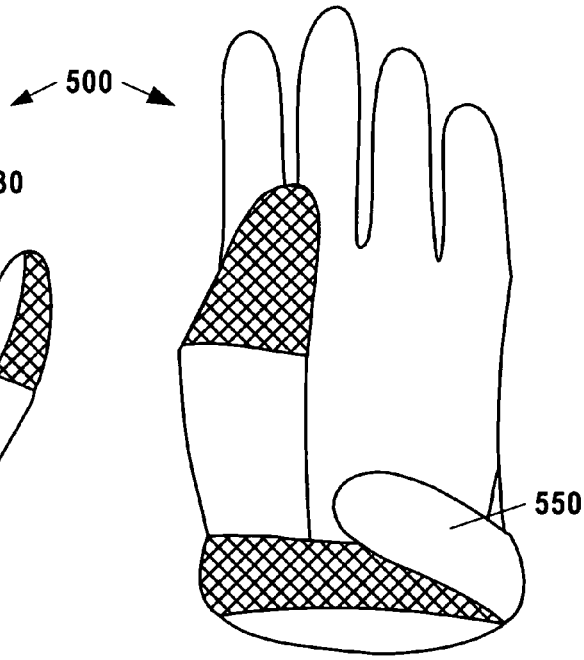
FIG. 13 is a palmar view of the full-hand glove of FIG. 12.

FIGS. 12 and 13 depict dorsal and palmar views of one an embodiment of a full-hand magnetic finger glove 500 incorporating the fabric materials and magnetic disc features of the above-noted finger glove embodiments. The finger glove 500 comprises a combination of elastic material 510 and substantially non-elastic fabric material 520 and includes a hook and fastener strap 550. A disc magnet 510 is attached to the inside surface of the dorsal side of the forefinger 530 of the glove 500 corresponding to the region of the finger nail. The gloves are preferably sold in pairs (left hand and right hand). In one embodiment, the gloves 500 are sold with a single magnet placed in only one of the gloves (right or left hand), or in both of the gloves. In another embodiment, the gloves 500 are sold with one or more magnets 510 affixed to the palmar side of the forefinger 530 of the glove 500 corresponding to the region of the fingertip. In yet another embodiment, the gloves 500 are sold with one or more magnets 510 affixed to the both the palmar and dorsal sides of the forefinger 530 of the glove 500 corresponding to the region of the fingertip. In yet other embodiments, the gloves 500 are sold with one or more magnets 510 affixed to one or more other fingers of the gloves, such as the middle finger 540.

Although the foregoing specific details describe various embodiments of the invention, persons reasonably skilled in the art will recognize that various changes may be made in the details of the apparatus of this invention without departing from the spirit and scope of the invention as defined in the appended claims.

I claim:

1. A magnetic, single-finger glove designed to conform to an adult human index finger, the magnetic, single-finger glove comprising:

a fabric assembly sized and shaped to be worn by the index finger, the fabric assembly defining regions corresponding to the proximal, middle, and distal segments of the index finger;

the fabric assembly including a substantially elastic top panel corresponding to substantially only the dorsal side of the finger and a substantially inelastic bottom panel corresponding to substantially only the palmar side of the finger; and a small magnet affixed to the fabric assembly in the region corresponding to the distal segment of the index finger, the small magnet being confined within an area on the fabric assembly of less than 0.5 square inches;

whereby the single-finger glove is operable to magnetically grasp small metal objects near the fingertip of a person wearing the single-finger glove.

2. The magnetic, single-finger glove of claim 1, wherein the magnet comprises a rare earth element.

3. The magnetic, single-finger glove of claim 2, wherein the rare earth element is neodymium.

4. The magnetic, single-finger glove of claim 1, wherein the magnet has a maximum energy product of at least 35 megagauss-oersteds.

5. The magnetic, single-finger glove of claim 1, wherein the magnet is a round disc magnet.

6. The magnetic, single-finger glove of claim 1, wherein the magnet weighs less than 0.002 pounds yet has a holding force of at least 1 pound.

7. The magnetic, single-finger glove of claim 1, wherein the magnet has a diameter of about 0.4 inches and a thickness of about 0.06 inches.

8. The magnetic, single-finger glove of claim 1, wherein the magnet has a volume of about 0.1 cubic centimeters.

9. The magnetic, single-finger glove of claim 1, wherein the magnet has a volume of less than 0.2 cubic centimeters and a maximum energy product of at least 35 megagauss-oersteds.

10. The magnetic, single-finger glove of claim 1, further comprising gripping members affixed to an outside surface of the bottom panel to facilitate gripping.

11. A magnetic, single-finger glove designed to conform to an adult human finger, the magnetic finger glove comprising:

an upper panel sized to correspond to substantially only the dorsal side of the finger with an elastic region corresponding to at least the proximal and middle segments of the dorsal side of the finger;

a substantially non-elastic bottom panel with a surface area sized to correspond to substantially only the palmar side of the finger; and a small magnet affixed to the upper or bottom panel in the region corresponding to the distal segment of the finger;

whereby the single-finger glove is operable to magnetically grasp small metal objects near the fingertip of a person wearing the single-finger glove.

12. The magnetic, single-finger glove of claim 11, wherein the magnet is affixed to the bottom panel in a region corresponding to the distal segment of the finger.

13. The magnetic, single-finger glove of claim 12, wherein the magnet is affixed to the bottom panel in a sub-region proximate to the ventral side of the distal phalanx head of the finger, whereby the single-finger glove facilitates tactile sensation by the person wearing the glove of the attachment of a small metallic object to the finger glove.

14. The magnetic, single-finger glove of claim 11, wherein the magnet is affixed to the top upper panel in the region corresponding to the fingernail of the finger.

15. The magnetic, single-finger glove of claim 11, wherein the magnet comprises a neodymium round disc magnet.

16. The magnetic, single-finger glove of claim 15, wherein the magnet weighs less than 0.002 pounds yet has a holding force of at least 1 pound.

17. The magnetic, single-finger glove of claim 11, wherein the magnet has a volume of less than 0.2 cubic centimeters and a maximum energy product of at least 35 megagauss-oersteds.

18. The magnetic, single-finger glove of claim 11, wherein the small magnet is confined within an area on the upper or bottom panel of less than 0.5 square inches.

19. The magnetic, single-finger glove of claim 11, wherein the upper and lower panels of the single finger glove form part of an assembly sized and shaped to encircle the proximal, middle, and distal segments of the finger.

20. The magnetic, single-finger glove of claim 11, further comprising gripping members affixed to an outside surface of the bottom panel to facilitate gripping.

* * * * *